United States Patent [19]

Ali et al.

[11] 4,067,149

[45] Jan. 10, 1978

[54] SANDING, BUFFING AND POLISHING TOOLS

[76] Inventors: Frank F. Ali; Phillip Glen Ali, both of 2973 Pascal Drive, Fairborn, Ohio 45324

[21] Appl. No.: 777,310

[22] Filed: Mar. 14, 1977

[51] Int. Cl.[2] ..... B24B 9/04

[52] U.S. Cl. ..... 51/364

[58] Field of Search ..... 51/168, 358, 364–369, 51/406

[56] References Cited

U.S. PATENT DOCUMENTS

| | | | |
|---|---|---|---|
| 1,907,904 | 5/1933 | Van Emburg | 51/369 X |
| 2,192,804 | 3/1940 | Schulte | 51/364 X |
| 2,259,685 | 10/1941 | Elsloo | 51/364 X |
| 2,485,295 | 10/1949 | Larson | 51/406 X |
| 2,725,694 | 12/1955 | Lukens | 51/364 X |
| 2,778,167 | 1/1957 | Klumpp | 51/364 X |

*Primary Examiner*—James L. Jones, Jr.
*Assistant Examiner*—Nicholas P. Godici
*Attorney, Agent, or Firm*—Jerome P. Bloom

[57] ABSTRACT

A sanding, buffing or polishing tool the body of which comprises an operating head a peripheral surface portion of which has a configuration defined by a line revolved about its central axis and includes therein at least one longitudinally extending cut which is non-radial in its inwardly directed sense, with reference to its orientation in said head. This cut is adapted to anchor one end of a section of strip material which wraps around said peripheral portion of the operating head to provide thereon an abrasive exterior surface.

5 Claims, 5 Drawing Figures

SANDING, BUFFING AND POLISHING TOOLS

BACKGROUND OF THE INVENTION

This invention relates to an improvement in sanding, buffing and polishing tools which renders them economical to fabricate, easy to assemble and disassemble and more efficient and satisfactory in use. The invention has particular advantage with reference to those tools as require the application of abrasive materials to a peripheral portion thereof the exterior surface of which has a configuration defined by a line revolved about a central longitudinal axis. It will be particularly described with reference to a tool wherein said exterior surface portion to which the abrasive material is applied has a cylindrical configuration. It should be understood that this illustration is by way of example and not by way of limitation.

Prior art tools of the nature with which we are here concerned have been variously constructed and have had the abrasive material which enables their required function applied in various manner. For example, in a case of such tools as have had their operating surfaces formed in a cylindrical configuration, the present state of the art provides a tool comprising a bolt-like shaft mounting thereon, between the head thereof and a threadedly engaged nut backing an annular washer, a resilient rubber-like tube segment which mounts in turn a replaceable sleeve the exterior surface portion of which embodies abrasive material. The arrangement is such that the parts must have a reasonable close tolerance, which has proven difficult to maintain with any degree of certainty. This stems, in part, from the fact that the respective parts are generally made in different facilities and by different companies. As a result, problems occur in the assembling and replacement of the abrasively surfaced sleeves. Not only this but prior art devices such as here described are relatively expensive to fabricate. Another potential problem found in the use of these prior art devices stems from the fact that the material of which the tube segment which mounts the abrasively surfaced sleeve is formed must be resilient to insure a proper friction fit of the sleeve. Apart from the fact that the fit is many times not as firm or as satisfactory as desired, in use of the tools so provided the backing for the sleeve may not be as firm as required to accomplish the proper results. As will be obvious, lack of uniformity and firmness in backing of the abrasively surfaced sleeve can detrimentally affect the uniformity of the results of its application.

An even more serious problem which has been encountered in use of these prior art devices on a high speed drill is that under load its rubber-like sleeve segment will many times fatigue, balloon and explode, an occurrence highly dangerous to the user. The rubber sleeve also has a tendency to crumble with age, in which event the use of the device produces flying particles of rubber which endanger not only the user but every person in his or her immediate vicinity. Its weight is another disadvantage of this prior art device when applied to a drill. It can create an overload condition with obvious unsatisfactory results.

Other prior art tools of a similar nature exhibit like problems in their fabrication and use. Where such tools have utilized sheet formed abrasive materials, the device provided to mount the same has, of necessity, been fabricated some times of multiple and some times of hinged parts, thereby adding substantially to their cost.

It is with the above problems in mind that the development of the subject invention proceeded.

SUMMARY OF THE INVENTION

The present invention does in fact provide a solution to and an elimination of the problems above noted in the art and does so by a provision of means exhibiting the utmost simplicity of fabrication and assembly.

A preferred embodiment of the present invention such as herein illustrated is adapted for a simple slip fit installation in a power driven chuck of a conventional nature. It comprises a shaft the operating end of which mounts a cup-shaped element of rigid or substantially rigid material the outer peripheral wall portion of which has its surface interrupted by a series of longitudinally extending, circumferentially spaced cuts. Each of these cuts is made at an acute angle to a radius of the cup-shaped element and each differs from the other as to the width of the cut. As shown, an abrasive exterior is provided peripherally of the cup by strip material the outer surface of which has abrasive properties and the backing of which is adhesive in character. This strip is applied by insertion of one end thereof in the one of said cuts designed to accommodate its thickness while the remainder is wrapped around the outer periphery of the cup to terminate back at the cut in which the strip is initially anchored. The application of the strip is simple and effective and it is at the same time readily releasable and replaceable.

The end of the drive shaft which mounts the cup is threaded and thrust through a central aperture in the base of the cup to project inwardly of the cup to a slight degree. The innermost face of the base of the cup is formed with a recess bounding its central aperture, which recess includes parallel side walls designed to confine opposite flat peripheral side surface portions of a nut through which the connecting end of the drive shaft is threaded as it is projected inwardly of the cup. The drive shaft is threadedly engaged by a further nut which positions immediately outward of the base of the cup. In the connection of the shaft to the cup the latter nut is turned up on the shaft to engage the cup base at its outer face, thereby to draw the nut interiorly of the cup into a clamped seated engagement with the base of the aforementioned recess. The lateral confinement of the interior nut prevents inadvertent turning or displacement thereof in use of the tool so provided.

In preferred embodiment the invention device will be made of plastic, enabling it to be strong yet light in weight and to maintain its bodily configuration and strength under load. In larger embodiments, such as a 4" unit, the weight of the invention device can be reduced as much as 90% from the weight of a conventional device applied to the same purposes. The configuration of the invention embodiments also insure against overload in use thereof. The benefit of the foregoing may be readily seen and is particularly important when considering the larger sanders. It is to be kept in mind that overload is not only disadvantageous to the tool but to the quality of the work which may be expected from the tool.

It is accordingly a primary object of the present invention to provide a sanding, buffing or polishing tool, easily connected to a power driven chuck, which is more economical to fabricate, more efficient and satisfactory in use and adaptable to a wide variety of applications.

Another object of the invention is to provide such a tool which is easy to assemble and disassemble.

A further object of the invention is to provide such a sanding, buffing or polishing tool the body of which comprises an operating head a peripheral surface of which has a configuration defined by a line revolved about its central axis and includes therein a longitudinally extending cut which is non-radial with reference to its orientation in said head, said cut being adapted to anchor one end of a section of strip material which wraps around said peripheral portion of the operating head to provide thereon an abrasive esterior surface.

An additional object of the invention is to provide a new and improved sanding, buffing or polishing tool the operating head of which has an exterior surface portion which is circular in cross section and includes therein several cuts which are circumferentially spaced and of different widths and selectively adapted to receive and anchor therein one end of an adhesively backed sheet material which is wrapped around said head to emcompass the same to provide it with an abrasive exterior surface.

Another object of the invention is to provide a sanding, buffing or polishing tool and elements thereof possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein is shown one but not necessarily the only form of embodiment of the present invention, FIG. 1 is an exploded view of a tool in accordance with the present invention;

Like parts are indicated by similar characters of reference throughout the several views.

Figure 1:
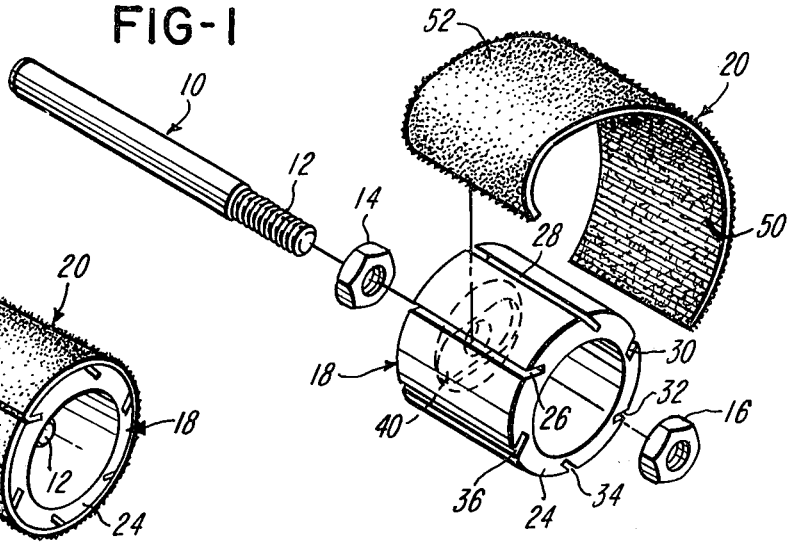
Figure 2:
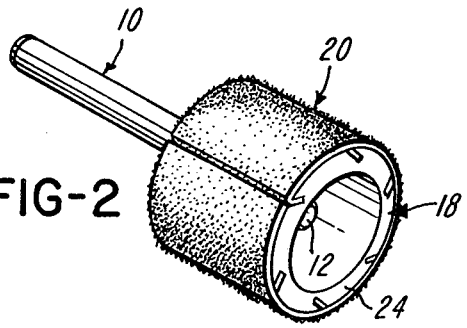
FIG. 2 is a perspective view of the tool of FIG. 1 in a fully assembled form.

The embodiment of the invention here illustrated comprises a rod-like shaft 10 one end portion 12 of which is threaded, two nuts 14 and 16, an operating head 18 and an abrasively surfaced strip element 20.

The operating head 18 has a cup shape, the base 22 of which has a perpendicularly projected cylindrically configured peripheral wall portion 24 formed integral with its outer periphery. The outer surface of the wall portion 24 is provided with a plurality of longitudinally extending, circularly spaced cuts, the cuts being respectively identified in the drawings by the numerals 26, 28, 30, 32, 34 and 36. Each of these cuts has a different width and each is non-radial as to its orientation with respect to the central longitudinal axis of the operating head 18. However, all the cuts are similarly angled in a direction inwardly of the head, in a sense which is counterclockwise to the direction the head will normally rotate in use.

Formed in centered relation to the innermost face of the base 22 is a recess 40. The base 22 also has a central aperture 42 providing therein a through passage the innermost end of which opens from the base of the recess 40. The side wall of the recess 40 includes a pair of respectively parallel straight line portions 44 and 46 connected at their respectively adjacent extremities, to either end thereof, by an arcuately configured wall portion 48.

Figure 3:
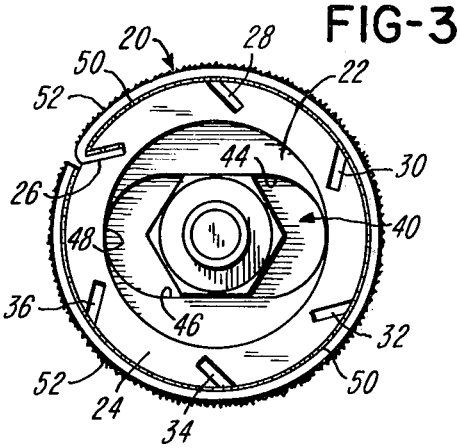
FIG. 3 is an end view of the tool of FIG. 2.
Figure 4:
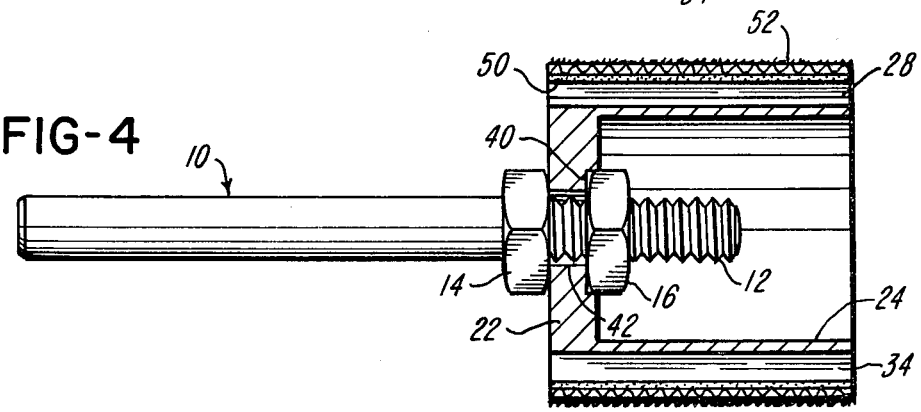
FIG. 4 is a sectional view of the illustrated tool on an enlarged scale.

The aperture 42 in the base 22 of the head 18 is so dimensioned as to permit the free passage therethrough of the end portion 12 of the shaft 10. In assembly of the shaft the projected extremity of its end portion 12 positions interiorly of the cup-shaped form of the operating head. At its extremity which positions interiorly of the head 18 the shaft 10 is threadedly engaged by the nut 16. As illustrated in FIG. 3 the nut 16 has a hex head and is adapted to be seated within and to the base of the recess 40 to have opposite peripheral side portions thereof confined by and in adjacent parallel relation to the recess wall portions 44 and 46. With this arrangement one is able to preclude inadvertent rotative movement of the nut 16 with reference to the base 22 to which it seats. As seen in FIG. 4 of the drawings, the nut 14 is threadedly engaged with the shaft end portion 12 at a location thereon which positions outwardly of the base 22 of the head 18. As will be obvious, on turning the nut 14 on the shaft 10, in a conventional manner, to cause it to abut the outermost face of the base 22, and then continuing the turning, the nut 16 is drawn and firmly clamped to the base 22. Provided at the time the nut 16 is established within the recess 40 in a contained position as previously described, it will be restrained from relative movement by the side wall portions 44 and 46. Thus one may easily and simply assemble and establish a desirable and relatively fixed position of the parts 10 and 18 through the medium of the nuts 14 and 16.

In the embodiment illustrated the strip 20 is a flexible sheet-like element having a generally elongate rectangular configuration. At what may be considered its back surface the strip 20 is covered by a layer 50 of suitable tenacious adhesive. Its outermost surface is formed with a layer of abrasive material 52.

Figure 5:
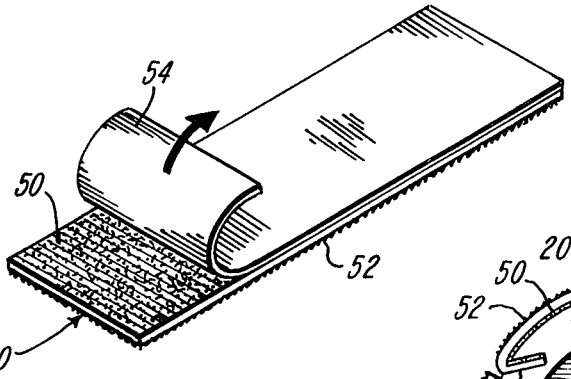
FIG. 5 illustrates the abrasively surfaced strip embodied in the tool of FIGS. 1–4.

Referring to FIG. 5, the strip element 20 to be utilized in connection with the operating head 18 is precut to the required size and its adhesive backing 50 will originally be covered by a sheet of impermeable material 54, one which may be readily separated from the adhesive at that time when the strip is required to be placed on the operating head 18.

The head 18 provides a means to be peripherally encompassed by the strip 20. As previously noted, the pre-cut strip is prepared for its application by first removing the impermeable cover sheet 54 from its backing relation to the adhesive 50. Once the sheet 54 is removed, depending upon the thickness of the strip, the user will insert one end thereof into a selected slot in the head 18 the width of which will accommodate the same in a close fit relation. As illustrated in FIG. 3, one end of the strip 20 has been inserted in that recess or notch defined by the cut 26. The strip 20 is so applied that the adhesive backing 50 of that portion of the strip 20 which is inserted will be in facing and abutted relation to the wall portion of the cut 26 which is on the clockwise side thereof. So anchored at one end, the free portion of the strip 20 is wrapped over and in encompassing relation to the outer peripheral surface of the head 18. As noted previously, the length of the strip 20 is so cut that the end of the strip remote from the anchored end thereof will terminate in immediate adjacent relation to the counterclockwise side wall portion of the cut 26. As the strip 20 is wrapped, the adhesive backing 50 will provide a tenacious connection of the strip to the head 18, on contact therebetween. The manner and ease with which the strip may be applied facilitates its firm and proper application by almost any person, including persons of relatively little intelligence and manual dexterity.

As may be seen further in FIG. 3 of the drawings, should one have to replace the strip 20 all one need do is to simply pry up the outermost end thereof and pull on the strip to cause it to unwrap until the free end portion aligns with the direction of the cut 26, whereupon the anchored portion thereof may be pulled free.

It is emphasized that the angling of the cuts in the head 18 will be such to comtemplate the drive of the head, as viewed in FIG. 3, in a counterclockwise direction. Under such conditions of use there will be a continuing tendancy of the strip 20 to cling to and adhere to the outer peripheral surface of the head 10 in the predetermined configuration and position desired. Since the strip 20 is backed by a firm and substantially rigid head structure it will be insured that the abrasive surface 52 of the strip will function in a most uniform and even wearing manner. The highly beneficial results of these factors is believed clear.

Instead of the cuts 26 through 32 inclusive as here illustrated being notches or recesses, they could in the alternative be formed as slots in the peripheral wall portion 24. However, this is not essential and not necessarily preferred.

The elements 10 and 18 may be formed of metal but their nature and character lend them to being molded or otherwise fabricated of plastic material.

It will be seen from the foregoing that the invention here provides a new and improved highly simplified sander which requires simple tooling for its fabrication, requires no special dexterity in the assembly of its parts and no special knowledge for either the assembly or the use thereof. These advantages lend the invention embodiments an ability to be used on a widespread and general basis by all types and sorts of people and businesses and for innumerable applications. As a matter of fact, the nature and character of the invention embodiments are such to lend themselves to their ready application to the chuck of almost any of the multitude of hand held power tools on the market.

While the head 18 has been shown to be cup-shaped and generally cylindrical in peripheral configuration, the head need not be so limited as to its shape. The invention concept can be applied to any head the peripheral surface of which can be formed by revolving a line of a selected configuration about a line which defines the central axis of the head.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A tool for sanding, buffing and/or polishing comprising an operating head the body of which includes a surface portion the peripheral configuration of which is defined by a line revolved about a central axis, a peripheral surface portion of said head having therein a plurality of cuts directed in a sense longitudinally and inwardly thereof to extend into the body of said head in a direction at an angle to a radius of said head, said cuts including cuts of different width and being formed to receive and to provide for an anchoring therein of one end of a selected segment of an abrasively surfaced sheet-like material to enable the remainder thereof to be wrapped over said peripheral surface portion of said head and to dispose in substantially coextensive relation thereto.

2. A tool as in claim 1 wherein said cuts extend longitudinally of and are positioned in circumferentially spaced relation about said peripheral surface portion of said head and said peripheral surface portion of said head is the outermost peripheral surface portion thereof.

3. A tool as in claim 1 wherein said head has a cup-shaped configuration and said plurality of cuts are formed in and extend longitudinally of its outer peripheral wall surface which comprises said peripheral surface portion of said head and each said cut has a different width.

4. A tool as in claim 3 wherein the inner surface of the base of said cup-shaped head has a recess including parallel spaced peripheral wall portions and between said parallel wall portions and in centered relation thereto an aperture, said aperture accommodating therein and having projected therethrough one end of a mounting shaft, said shaft mounting thereon and in adjustable relation thereto nut-like elements, one exterior to and the other interiorly of said cup-shaped head, said interior nut being arranged to be fixedly confined in said recess between said parallel wall portions by the adjustment of the exterior nut on said shaft to engage the outer surface of the base of said cup-shaped head, in clamping relation thereto.

5. A tool for sanding, buffing and/or polishing comprising an operating head the body of which includes a surface portion the peripheral configuration of which is defined by a line revolved about a central axis, a peripheral surface portion of said head being circular in cross section and including therein a plurality of cuts which are circumferentially spaced and of different widths, said cuts being directed along said surface portion and inwardly thereof to extend into the body of said head in a sense at an angle to a radius of said head, said cuts being formed to receive and provide for an anchoring therein of one end of a segment of an abrasively surfaced sheet-like material to enable the remainder thereof to be wrapped about said peripheral surface portion of said head and to dispose in substantially encompassing relation thereto.

* * * * *